US012145756B2

(12) United States Patent
Schulz et al.

(10) Patent No.: US 12,145,756 B2
(45) Date of Patent: Nov. 19, 2024

(54) STRAP CHANNEL HAVING IMBRICATE FLAPS

(71) Applicant: Signode Industrial Group LLC, Tampa, FL (US)

(72) Inventors: Friedhelm Schulz, Wipperfürth (DE); Hans G. Kastner, Wulfrath (DE)

(73) Assignee: Signode Industrial Group LLC, Tampa, FL (US)

( * ) Notice: Subject to any disclaimer, the term of this patent is extended or adjusted under 35 U.S.C. 154(b) by 154 days.

(21) Appl. No.: 17/905,006

(22) PCT Filed: Feb. 25, 2021

(86) PCT No.: PCT/US2021/019552
§ 371 (c)(1),
(2) Date: Aug. 25, 2022

(87) PCT Pub. No.: WO2021/173766
PCT Pub. Date: Sep. 2, 2021

(65) Prior Publication Data

US 2023/0112043 A1 Apr. 13, 2023

(30) Foreign Application Priority Data

Feb. 28, 2020 (DE) ..... 10 2020 105 350.9

(51) Int. Cl.
*B65B 13/06* (2006.01)
*B65B 13/20* (2006.01)
(Continued)

(52) U.S. Cl.
CPC ..... *B65B 13/06* (2013.01); *B65B 13/20* (2013.01); *B65B 35/22* (2013.01); *B65B 35/58* (2013.01)

(58) Field of Classification Search
CPC ..... B65B 13/06; B65B 13/20; B65B 35/22; B65B 35/58
See application file for complete search history.

(56) References Cited

U.S. PATENT DOCUMENTS 2,968,234 A * 1/1961 Mosey ..... B65B 13/06 100/26
3,118,368 A * 1/1964 Lems ..... B65B 13/06 100/26
(Continued)

FOREIGN PATENT DOCUMENTS

CN 208086087 U 11/2018
CN 209795913 U 12/2019
(Continued)

OTHER PUBLICATIONS

"International Search Report and Written Opinion", from corresponding PCT patent application No. PCT/US2021/019552, Jun. 9, 2021.

*Primary Examiner* — Thomas M Wittenschlaeger
*Assistant Examiner* — David G Shutty
(74) *Attorney, Agent, or Firm* — Neal, Gerber & Eisenberg LLP

(57) ABSTRACT

A strapping device for strapping packages, having a packing table via which the package is moved along a movement path through the device, having a strapping frame which is oriented transversely with respect to the movement path and through which the package passes during its movement through the device, having a strap channel which is open in the direction of the frame interior, is formed by the strapping frame and has at least two vertical channel legs which are arranged on both sides of the movement path of the package, and having a multiplicity of strap channel flaps which are secured on the strapping device channel so as to be moveable by way of an articulated leg and are provided with a
(Continued)

covering leg which overlies approximately half of the channel opening in the direction of a strap channel longitudinal axis.

17 Claims, 4 Drawing Sheets

(51) Int. Cl.
*B65B 35/22* (2006.01)
*B65B 35/58* (2006.01)

(56) References Cited

U.S. PATENT DOCUMENTS 3,376,807 A * 4/1968 Sterner ..... B65B 13/06 100/26
3,613,557 A * 10/1971 Coleman ..... B65B 13/06 100/26
3,768,396 A * 10/1973 Coleman ..... B65B 13/06 100/26
3,899,963 A * 8/1975 Tremper ..... B65B 13/06 100/25
4,520,720 A * 6/1985 Urban ..... B65B 13/06 53/589
5,355,786 A * 10/1994 Tipton ..... B65B 13/06 53/589
5,778,772 A * 7/1998 Schwede ..... B65B 13/06 53/589
6,363,689 B1 * 4/2002 Rodriguez ..... B65B 27/12 53/399
6,951,088 B2 * 10/2005 Rodriguez ..... B29C 66/49 53/399
6,955,119 B2 * 10/2005 Bobren ..... B65B 13/18 198/861.5
6,990,894 B2 * 1/2006 Lininger ..... B65B 13/32 100/29
7,234,394 B1 * 6/2007 Bell, Jr. ..... B65B 13/06 242/615.3
7,757,468 B2 * 7/2010 Kastner ..... B65B 13/06 53/589
2003/0006012 A1 * 1/2003 Lai ..... B65B 13/06 156/443
2008/0236409 A1 * 10/2008 Cozzutto ..... B65B 13/06 100/2
2008/0276578 A1 11/2008 Kastner

FOREIGN PATENT DOCUMENTS

DE 4417382 A1 11/1995
DE 20313581 U1 11/2003
JP S56161909 A 12/1981
JP H0627503 U 4/1994

* cited by examiner

STRAP CHANNEL HAVING IMBRICATE FLAPS

PRIORITY

This application is a national stage application of PCT/US2021/019552, filed on Feb. 25, 2021, which claims priority to and the benefit of German Patent Application No. 10 2020 105 350.9, filed on Feb. 28, 2020, the entire contents of which are incorporated herein by reference.

BACKGROUND

The present disclosure relates to a strapping device for strapping packages.

Various strapping devices are well known from the prior art. By way of example there may be mentioned here DE 44 17 382 A1 or else DE 203 135 81 U1. Both show strapping devices having a packing table which is provided with a row of rollers on which large packages, for example pallets provided with cardboard packaging, are guided through a strapping frame. The strapping device frame first of all comprises two vertical posts which are situated on each side of the packing table and on which a vertically moveable platen is arranged. The strapping frame has a strap channel which extends along the packing table, the two vertical posts and along the platen.

The strap channel, which is open towards the frame interior, is closed by flaps, as illustrated, for example, in U.S. Patent Application Publication No. 2008/0276578 A1. The flaps serve to prevent the strap inserted in the strap channel from prematurely exiting the channel.

During the retraction of the strap, which leads to the strap being clamped around the package, the strap opens the flaps, which are held closed by spring force, and thus exits the strap channel.

The prior art which cannot be demonstrated by documentary evidence discloses providing the vertical strap channel portions with a multiplicity of short strap channel flaps, as are provided, for example in DE Patent Application Publication 203 135 81 U1, for the strapping device guide provided between the strapping device supply and strap insertion device.

The deflection devices transferring the strap from the platen-side channel portion into the vertical channel portions spread the strap channel flaps in the respective transfer region from the horizontal channel portion into the vertical channel portion. It is thus possible for the strap to be introduced into the respective vertical channel portion in virtually every platen position.

Moveover, when the strap is retracted and clamped around the package, only a small region of the vertical channel portions opens in each case. The strap is thus released from the strap channel in portions. The retaining forces therefore exerted on the strap ensure a clean position of the strap on the package.

A multiplicity of short flaps for closing the strap channel, in particular the vertical channel portions, has proved to be extraordinary successful. However, it has been found that the strap quality is sometimes subject to considerable fluctuations. Torsional stresses along the strap longitudinal axis, frayed strap longitudinal edges and fluctuating strap widths result in the strap running irregularly in the strap channel during the insertion operation. Consequently, collisions can occur between the strap tip and edges of the strap channel flaps, in which case the strap tip then exits the strap channel in the region of a parting joint between the strap channel flaps arranged next to one another.

The resulting machine disruption generally has to be remedied by the maintenance personnel, this being associated with machine downtimes and costs.

U.S. Pat. No. 3,768,396 also shows a strapping device having a strap channel which is closed by a multiplicity of flaps. Flaps of a flap pair are arranged in a funnel shape with respect to one another, and adjacent flap pairs overlap one another. This is intended to achieve improved transverse guidance of the strap. However, the strap channel flaps are dependent on one another in their opening movement and allow only one pull-out direction of the strap. Strap transfer by way of a deflector of the platen that engages in the vertical strap channel portion is not possible.

BRIEF SUMMARY

The present disclosure relates to a strapping device for strapping packages, having a packing table via which the package is moved along a movement path through the device, having a strapping frame which is oriented transversely with respect to the movement path of the package and through which the package passes during its movement through the device, having a strap channel which is open in the direction of the frame interior, is formed by the strapping frame and has at least two vertical channel legs arranged on both sides of the movement path of the package, having a multiplicity of strap channel flaps which are secured to the strap channel so as to be moveable by way of an articulated leg and are provided with a covering leg which overlies approximately half of the channel opening in the direction of a strap channel longitudinal axis, wherein two strap channel flaps opposite one another along the strap channel longitudinal axis form a strap channel flap pair whose covering legs jointly close the strap channel opening, an opening plane is situated between the strap channel flaps of a strap channel flap pair, is arranged parallel to the strap channel longitudinal axis and along which a strap located in the strap channel can be pulled, with a flap opening movement, out of the strap channel and can be clamped around the package, wherein the covering legs of each strap channel flap pair together form at least one wedge-shaped strap pull-out contour which, starting from the wedge tip arranged in the opening plane, widens in the direction of the parting plane between two strap channel flap pairs, and wherein two strap channel flap pairs arranged next to one another along the strap channel longitudinal axis form between them a parting joint along which there is defined a parting plane which separates the two strap channel flap pairs.

One advantage of the present disclosure is therefore to provide a strapping device of the type in question in which reliable strap guidance is ensured.

This advantage is achieved by a strapping device having covering legs of a strap channel flap pair each form a covering extension which extends beyond the parting plane and at least partially overlies the respectively adjacent covering leg of an adjacent strap channel flap, and the strap channel flaps of a strap channel flap pair are moveable, independently of the strap channel flaps of an adjacent strap channel flap pair, between an open position and a closed position.

One advantage of the present disclosure can first of all be seen in the covering extensions of the covering legs of each strap channel flap pair. Since they extend over the parting plane of adjacent strap channel flap pairs, they close the parting joint between the strap channel flap pairs, thereby effectively avoiding a situation in which the strap exits the parting joint. Such a guidance of the strap is thus ensured even if its quality is subject to strong fluctuations. Machine downtimes are effectively reduced, which strongly improves the reliability of the strapping device according to the present disclosure.

However, the present disclosure takes care to ensure that, in spite of the covering extensions spanning the parting plane, the strap channel flaps of adjacent strap channel flap pairs remain moveable independently of one another, that is to say can assume an open or closed position independently of one another. This first of all ensures that, during retraction and clamping, the strap can leave the strap channel in a direction-independent manner. For example, if the retraction forces and the package contour require, the strap can leave the vertical channel portion both in a region of a deflector near the platen and in the region of a deflector near the packing table, that is to say in both corner regions of the strap device frame.

Furthermore, the independent movability of adjacent strap channel flap pairs ensures that the platen-side channel deflection portions can engage in and also move out of the respective vertical channel portion.

In a preferred embodiment, there is provision that each covering extension is set out in the direction of the frame interior with respect to a covering plane defined by the covering leg in order to overlie the respectively adjacent covering leg.

The setting out of the covering extensions with respect to the covering plane defined by the adjacent covering leg is one possibility of creating a sufficient distance between the covering extension and covering leg such that, during an opening movement, the covering leg can pivot through below the covering extension overlying it. In this way, the aforementioned movement decoupling can be realized in a particular simple manner.

For particularly secure strap guidance, there is provision that each covering extension overlies approximately half of the adjacent covering leg. There is then provision that the strap pull-out contour is formed by the covering extensions of a strap channel flap pair.

By virtue of the covering extensions having a comparatively long extent as measured in the channel longitudinal direction, it is possible to configure the strap pull-out contour in an optimized manner.

Thus, for example, there is provision that the wedge tip of the strap pull-out contour is situated in the region of the parting plane and widens from there towards the free end of the covering extensions.

The resultant possibilities of realizing small wedge angles with comparatively large wedge surfaces allow the frictional forces occurring when pulling the strap out of the channel to be minimized and the pulling-out of the strap to be made gentle.

The most advantageous effect is achieved if the ends of the covering extensions are oriented counter to the strap insertion direction.

If the covering extensions are directed counter to the strap insertion direction, there are no collision edges which, upon a collision with the strap tip, lead to exiting in the region of the parting joint between adjacent strap channel flaps. A strap tip moving in the strap channel in the direction of the frame interior will thereby without exception be guided back again in the direction of the channel bottom.

Furthermore, there is provision that the wedge-shaped strap pull-out contour formed by the covering extensions is oriented in the strap insertion direction.

There is also provision that the covering legs of each strap channel flap pair form a wedge-shaped strap pull-out contour at the opposite end of the covering extensions, said contour being oriented counter to the strap insertion direction.

Furthermore, there is provision that the covering extensions at least partially cover the wedge-shaped strap pull-out contour formed by the covering legs of the adjacent strap channel flap pair.

The present disclosure furthermore makes provision for an opening gap with a constant gap width to be formed between the strap channel flaps of a strap channel flap pair along the opening plane.

Finally, one embodiment of the present disclosure provides for the edges of the covering extensions that delimit the strap pull-out contour to be provided with bevels in order to minimize the friction occurring, when pulling out the strap, between the covering extensions and the strap.

BRIEF DESCRIPTION OF THE SEVERAL VIEWS OF THE DRAWINGS

A better understanding of the present disclosure along with further advantages can be gathered from the following description of one exemplary embodiment, in which.

DETAILED DESCRIPTION

Figure 1:
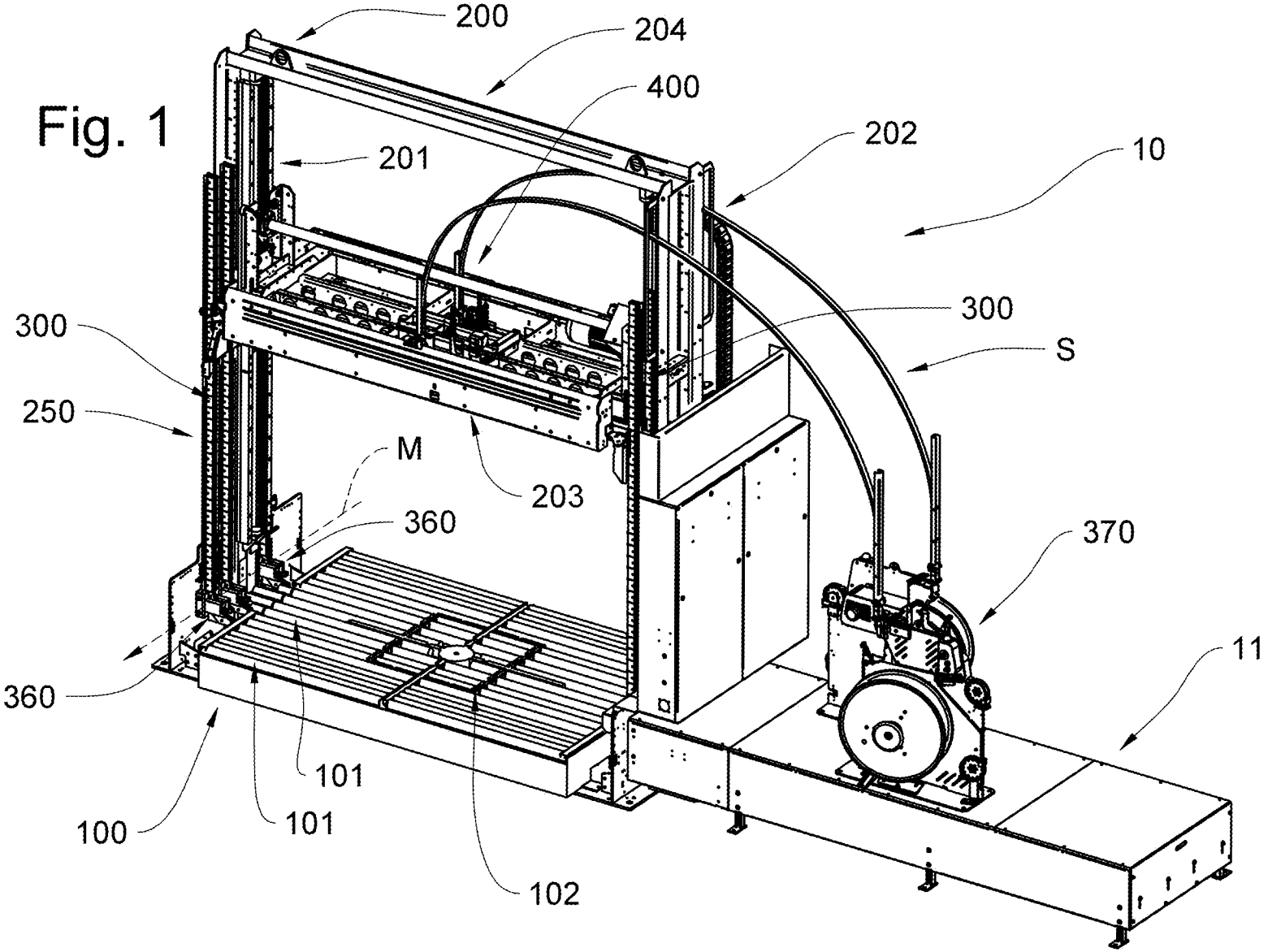
FIG. 1 shows a strapping device according to one embodiment of the present disclosure in an overall view.

In the figures, a strapping device according to one embodiment of the present disclosure provided overall with the reference number 10. The strapping device 10 has first of all a packing table 100 which is provided with a multiplicity of rollers 101, at least some of which are driven. The driven rollers 101 serve to move a package (not shown in further detail) through the device 10.

The packing table 100 has a rotary device 102 by way of which the package can if required by rotated through 90° for a cross-strapping operation. A strapping device frame 200 has two vertical supports 201 and 202 which are each adjoined to the side of the packing table and along which a platen 203 can be moved vertically up and down. At their upper ends, the vertical supports 201 and 202 are connected by a supporting strut 204.

The strapping frame 200 carries the strap channel 250. The strap channel 250 comprises vertical channel legs 300 arranged on each vertical support 201, 202. A horizontal, upper-level channel leg (not shown further) is arranged in the platen 203. A lower, horizontally extending channel leg (not shown either) is as a rule arranged in the packing table in an interspace between the rollers 101 illustrated.

Moreover, the strapping device 10 illustrated in FIG. 1 has insertable channel legs which are arranged in the bayonet box 11 arranged at the side of the packing table 100. As an alternative to the channel leg arranged in the packing table 100, they can be extended from the bayonet box 11 in the direction of the opposite vertical legs 300 and be inserted there into receiving shoes 360. In this way, it is possible for example to enter runner interspaces of pallets such that a package seated on a pallet can be arranged firmly on the pallet by way of the strapping.

On the bayonet box 11 there is arranged a strap storage unit 370 from which a strap is fed via a feed rail S in the direction of a strap insertion device 100 arranged on the platen 203.

The device in FIG. 1 has a plurality of vertical strapping planes which are arranged successively in the package run-through direction. Therefore, the vertical supports 201, 202 each have a plurality of vertical channel legs 300. In a corresponding manner, the horizontal channel legs are also multiply present. In order to be able to use at least two strapping planes in parallel, two strap insertion devices 400 are provided.

Figure 2:
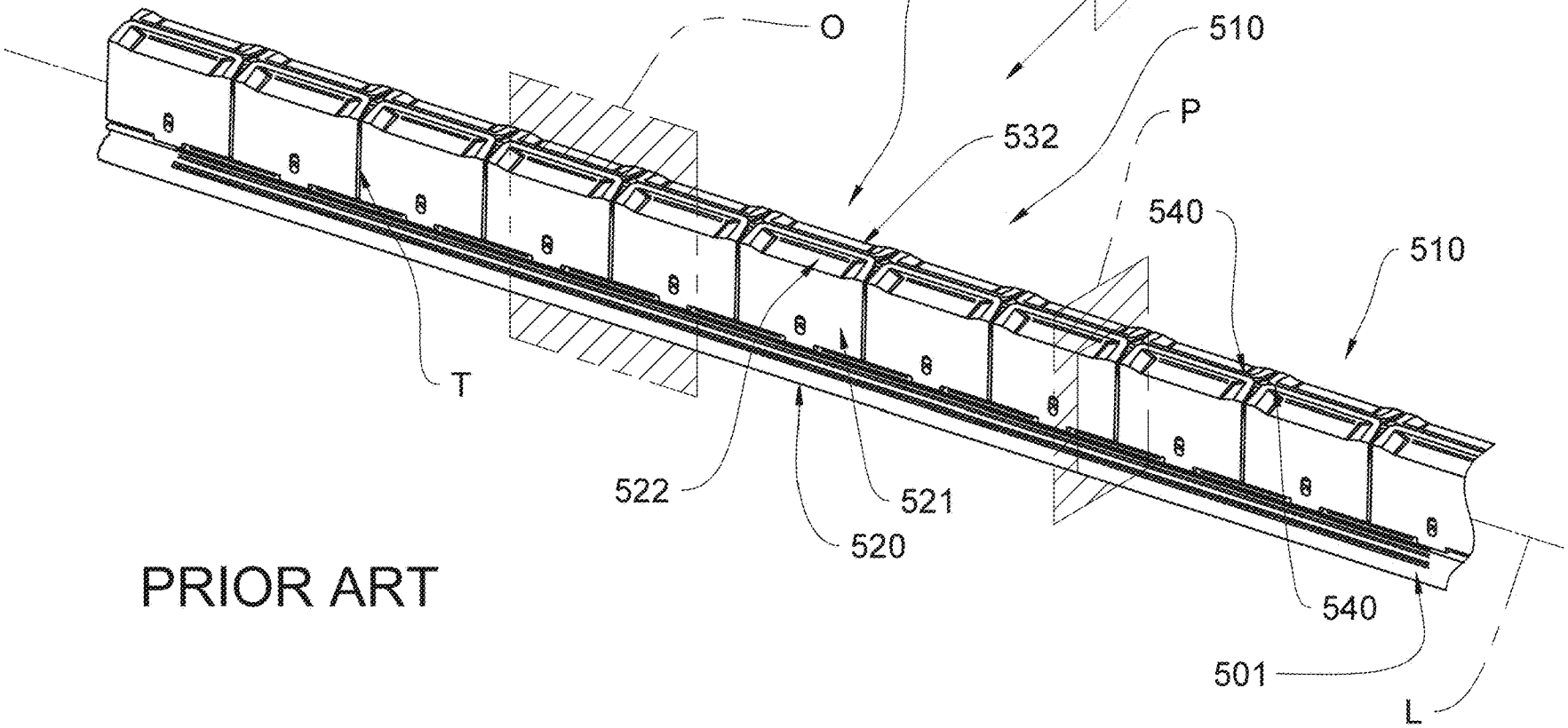
Fig. 2 PRIOR ART
FIG. 2 shows a partially illustrated strapping channel according to prior art which cannot be demonstrated by documentary evidence.

FIG. 2 shows the portion of a vertical channel leg from the prior art, which is provided overall with the reference sign 500. In the prior art, the vertical channel leg 500 has a row of strap channel flap pairs 510 arranged successively along the strap channel longitudinal axis L. Each strap channel flap pair has a first flap 520 in the strap channel, with an articulated leg 521 and a covering leg 522. The articulated leg 521 serves for pivotably arranging the strap channel flap 520 on the channel body 501 and extends approximately vertically to a strap channel bottom (not shown in further detail). The covering leg 522 is arranged on the articulated leg 521 and overlies approximately half of the channel opening.

The second strap channel flap 530 is formed mirror-symmetrically with respect to the first strap channel flap 520 and has an articulated leg 531 and likewise a covering leg 532. With respect to the strap longitudinal axis L, said second strap channel flap is arranged opposite the first strap channel flap 520 on the channel body 501, with the result that the covering leg 532 of the second strap channel flap 530 extends over approximately half of the channel opening in the direction of the first strap channel flap 520. In this way, the covering legs 522 and 532 of the strap channel flap pair 510 cover the channel opening region situated between the strap channel flaps 520 and 530.

An opening plane O is situated between the strap channel flaps 520 and 530 of each strap channel flap pair 510 in the region of the mutually opposite end sides of the covering legs 522 and 532. This opening plane is arranged parallel to the strap channel longitudinal axis and generally coincides therewith. Along this opening plane, the strap located in the strap channel can be pulled out of the vertical channel leg 500 with a flap opening movement.

Each strap channel flap pair forms in the prior art a wedge-shaped strap pull-out contour 540 which assists the opening of the strap channel flaps 520, 530 when the strap is being pulled out.

Between strap channel flap pairs arranged adjacent to one another there is situated a parting joint along which there is defined a parting plane P which separates the strap channel flap pairs 510.

Each strap channel flap pair 510 in the prior art forms a wedge-shaped strap pull-out contour 540 by way of its covering leg 522, 532. This wedge-shaped strap pull-out contour 540 opens, starting from a wedge tip arranged in the region of the opening plane O, in the direction of the adjacent parting plane P. It assists the opening movement of the strap channel flaps 520, 530 when the strap is being pulled out of the vertical channel leg 500.

Figure 3:
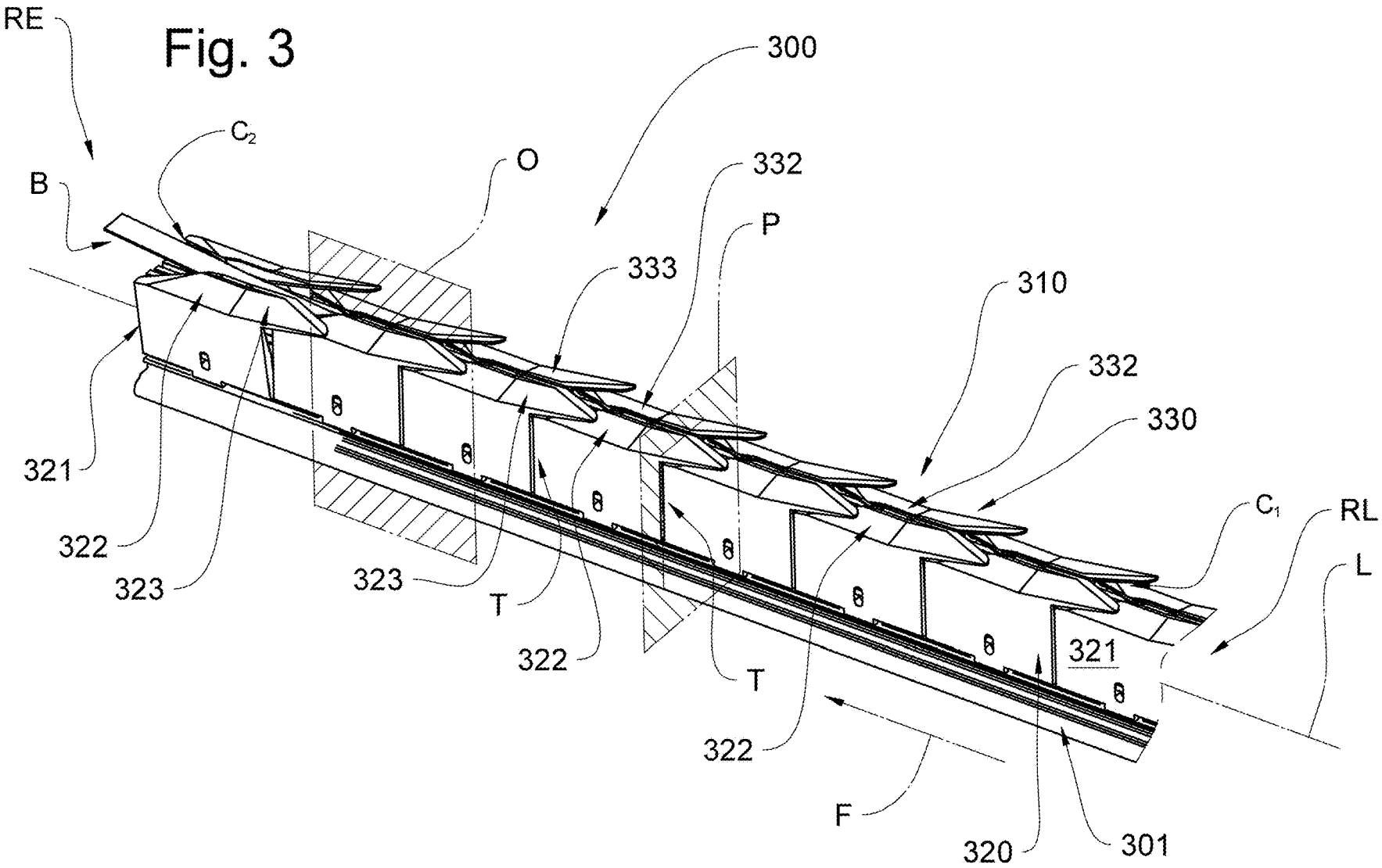
FIG. 3 shows a partially illustrated strap channel according to one embodiment of the present disclosure, and FIGS. 4 and 5 each show a strap channel flap of a strap channel flap pair of one embodiment of the present disclosure.

FIG. 3 now shows a subportion of the strap channel 250 according to one embodiment of the present disclosure, namely a subportion of a vertical channel leg 300. According to one embodiment of the present disclosure, it is also the case here that a plurality of strap channel flap pairs 310 are arranged next to one another along the channel longitudinal center axis L. Each strap channel flap pair includes a first strap channel flap 320 and a second strap channel flap 330. The strap channel flaps 320, 330 are pivotably fastened to the channel body 301 by way of their respective articulated leg 321, 331, whereas—analogously to the prior art—the respective covering leg 322, 332 in each case overlies half of the strap channel opening, with the result that the strap channel flap pair 310 keeps the respectively assigned strap channel opening portion closed.

As in the prior art, an opening plane O is situated between the covering legs 322, 332 of the strap channel flap pair 310, along which a strap B can be pulled out of the strap channel 250, here out of its vertical portion 300, with an opening movement of the strap channel flaps 320, 330.

Between the articulated legs 321, 331 of adjacent strap channel flap pairs 310 there is likewise situated a parting joint T along which there is defined a parting plane P which separates the strap channel flap pairs 310.

What is new in relation to the prior art described in FIG. 2 is the presence of covering extensions 323, 333. The latter are arranged on the covering legs 322, 332 and extend beyond the parting plane P in the direction of an adjacent strap channel flap pair 310. The covering extensions 323, 333 here overlie the respective covering leg 322, 332 of the adjacent strap channel flap pair 310. Here, the covering extensions extend counter to the strap insertion direction F.

As can also be seen from FIG. 3, the covering extensions 323, 333 are set out, with respect to a plane (not shown) defined by the covering legs 322, 332, in the direction of the frame interior or in the strap pull-out direction. This ensures that the strap channel flaps 320, 330 of adjacent strap channel flap pairs 310 can open independently of one another. It is thus readily possible that, during the opening movement of the strap channel flaps 320, 330, the covering legs 322, 332 can dip away below the covering extensions 323, 333 of an adjacent strap channel flap pair. With opening of the strap channel flaps 320, 330, it is thus possible for the strap B to be pulled out not only from the channel end RE on the right with respect to the drawing plane, as illustrated in FIG. 3. It is also possible for the strap to be pulled out in such a way from the channel end RL on the left with respect to the drawing plane in FIG. 3, although this is not shown here for reasons of clarity. It is also readily possible to open any desired flap pair 310 between two adjacent flap pairs 310, although this occurs probably at most for maintenance purposes during the regular operation of the strapping device.

A comparative viewing of FIGS. 2 and 3 makes the advantages of the strap channel flaps 320, 330 according to the present disclosure clearly apparent. If a strap is inserted into the strap channel 500 from the prior art, said channel is indeed in principle closed by the strap channel flaps 520, 530. However, the parting joints Tin the region of the parting plane P extend not only between the adjacent articulated legs 521, 531 of adjacent strap channel flap pairs 510 but also between the covering legs 522,532 of adjacent strap channel flap pairs 510. This is aggravated by the fact that the strap pull-out contours 540 of adjacent strap channel flaps 510 in the prior art according to FIG. 2 further increase the inter-spaces present between adjacent strap channel flap pairs 510 in the region of the covering legs 522, 532.

If a strap of low quality is then inserted, for example with torsion along the strap longitudinal axis or else with a torn or frayed strap tip, it can exit the parting joint T in the region of the parting plane between adjacent strap channel flap pairs 510, in particular between adjacent covering legs 522, 532 of adjacent strap channel flap pairs 510. By contrast, the vertical leg 300 according to FIG. 3 that is provided with strap channel flaps 320, 330 according to the present disclosure covers the problematic parting joint T in the region of the covering legs 322, 332 of adjacent strap channel flap pairs 310 and, in particular with covering extensions 323, 333 directed against the insertion direction F, prevents the strapping band from exiting the parting joint T.

However, the large area of overlap between the covering extension 323, 333 and the adjacent covering leg 322, 332 allows yet a further improvement in the strap channel flaps 320, 330 according to the present disclosure. The strap pull-out contours C1, C2 illustrated in FIG. 3 have small wedge angles with long wedge surfaces. This reduces the frictional forces between the strap B and the strap channel flaps 320, 330 when pulling out the strap B. The wedge angle, that is to say the opening angle of the strap pull-out contours C1, C2 as measured in the region of the wedge tip, can be 45° or less.

Figure 5:
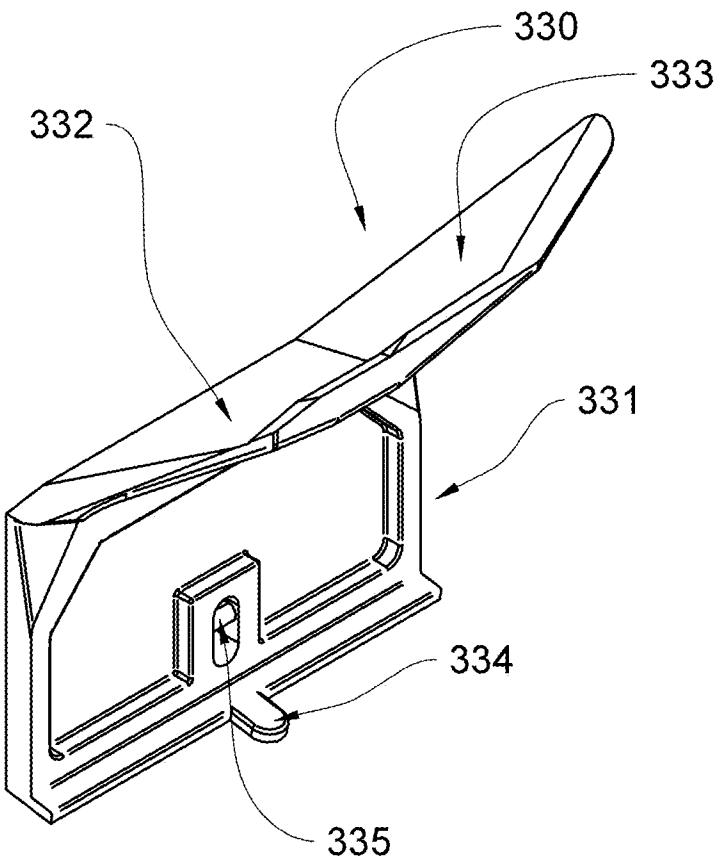
Figure 4:
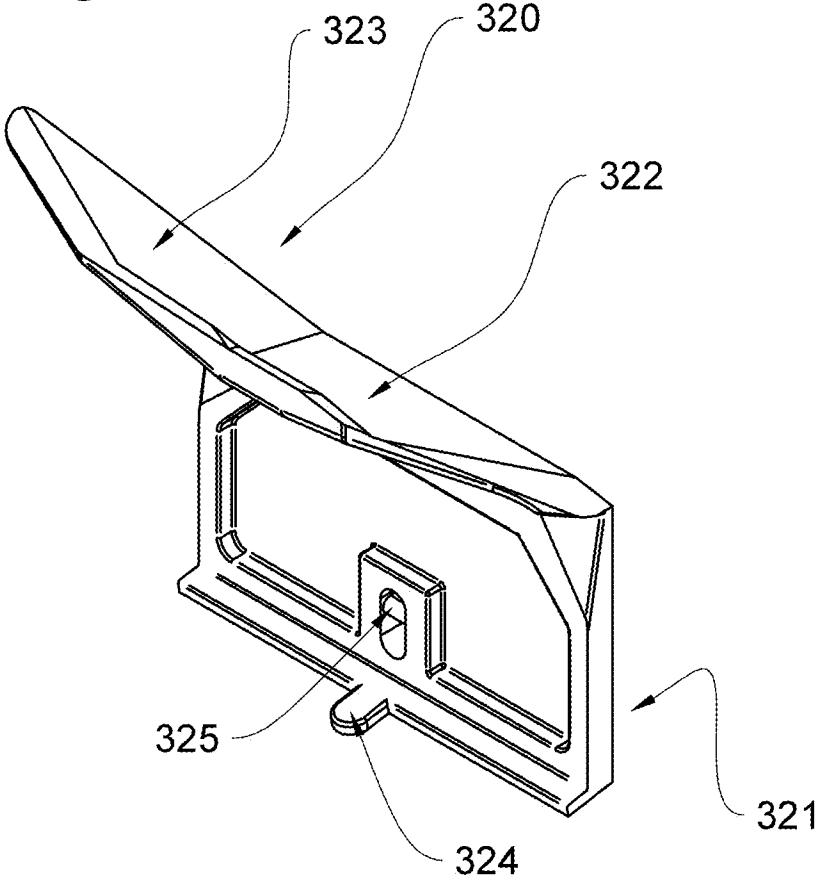

In FIGS. 4 and 5, the strap channel flaps 320, 330 according to this embodiment of the present disclosure are each illustrated once again, individually. They each show perspective views of the lateral surface of the respective articulated leg 321, 331 that in each case faces the channel interior. It is also evident from these illustrations that the respective covering extension 323, 333 carried by the covering layer 322, 332 is set out in relation to a plane defined by the respective covering leg 322, 332.

When the strap channel flaps 320, 330 are assigned to one another to form a strap channel flap pair 310, they engage by way of bearing lugs 324, 334 in the channel body 310. A common spring element, as a rule a helical spring (not shown), has its first end fastened to the spring web 325 of the first strap channel flap 320 and has its second end fastened to the spring web 335 of the second strap channel flap 330. In this way, the spring element holds the strap channel flaps 320, 330 of a strap channel flap pair 310 against one another in the closed position, with the result that the above-described opening movements are carried out against the build-up of spring preloading.

It should thus be appreciated from the above that in various embodiments, the present disclosure relates to a strapping device for strapping packages, having a packing table via which the package is moved along a movement path through the device, having a strapping frame which is oriented transversely with respect to the movement path and through which the package passes during its movement through the device, having a strap channel which is open in the direction of the frame interior, is formed by the strapping frame and has at least two vertical channel legs which are arranged on both sides of the movement path of the package, having a multiplicity of strap channel flaps which are secured on the strapping device channel so as to be moveable by way of an articulated leg and are provided with a covering leg which overlies approximately half of the channel opening in the direction of a strap channel longitudinal axis, wherein two strap channel flaps opposite one another along the strap channel longitudinal axis form a strap channel flap pair whose covering legs jointly close the strap channel opening, an opening plane O is situated between the strap channel flaps of a strap channel flap pair, is arranged parallel to the strap channel longitudinal axis and along which a strap located in the strapping device channel can, with a flap opening movement, be pulled out of the strap channel and clamped around the package, the covering legs of each strap channel flap pair together form at least one wedge-shaped strap pull-out contour C2 which, starting from the wedge tip arranged in the opening plane O, widens in the direction of the parting plane P between two strap channel flap pairs, and wherein two strap channel flap pairs arranged next to one another along the strap channel longitudinal axis form between them a parting joint T along which there is defined a parting plane P which separates the two strap channel flap pairs, and is characterized in that the covering legs of a strap channel flap pair each form a covering extension which extends beyond the parting plane P and at least partially overlies the respective adjacent covering leg of an adjacent strap channel flap, the strap channel flaps of a strap channel flap pair are moveable, independently of the strap channel flaps of an adjacent strap channel flap pair, between an open position and a closed position.

List of reference signs

| | |
|---|---|
| 10 | Strapping device |
| 11 | Bayonet box |
| 100 | Packing table |
| 101 | Rollers |
| 102 | Rotary device |
| 200 | Strapping frame |
| 201 | Vertical support |
| 202 | Vertical support |
| 203 | Platen |
| 204 | Supporting strut |
| 250 | Strap channel |
| 300 | vertical channel leg |
| 301 | Channel body |
| 310 | Strap channel flap pair |
| 320 | first strap channel flap |
| 321 | Articulated leg |
| 322 | Covering leg |
| 323 | Covering extension |
| 324 | Bearing lug |
| 325 | Spring web |
| 330 | second strap channel flap |
| 331 | Articulated leg |
| 332 | Covering leg |
| 333 | Covering extension |
| 334 | Bearing lug |
| 335 | Spring web |
| 360 | Receiving shoe |
| 370 | Strap storage unit |
| 400 | Strap insertion device |
| 500 | vertical channel leg (prior art) |
| 501 | Channel body |
| 510 | Strap channel flap pair |
| 520 | first strap channel flap |
| 521 | Articulated leg |
| 522 | Covering leg |
| 530 | second strap channel flap |
| 531 | Articulated leg |
| 532 | Covering leg |
| 540 | wedge-shaped strap pull-out contour |
| C1 | Strap pull-out contour |
| C2 | Strap pull-out contour |
| RE | Right channel end |
| RL | Left channel end |
| F | Strap insertion direction |
| S | Feed rail |
| M | Package run-through direction |
| L | Strap channel longitudinal axis |
| O | Opening plane |
| P | Parting plane |
| B | Strapping strap |
| T | Parting joint |

The invention claimed is:

1. A strapping device comprising:

a packing table;

a strapping frame at least partially above the packing table and at least partially defining a strap channel having a strap channel opening;

a pair of first strap channel flaps connected to the strapping frame, each first strap channel flap comprising a first covering leg that overlies part of the strap channel opening, each first covering leg comprising an upwardly extending covering extension; and a pair of second strap channel flaps connected to the strapping frame adjacent to the pair of first strap channel flaps, each second strap channel flap comprising a second covering leg that overlies part of the strap channel opening, each second covering leg comprising an upwardly extending covering extension, wherein each second covering leg overlies at least part of a respective one of the first covering legs of the pair of first strap channel flaps, wherein each first strap channel flap is movable independently of each second strap channel flap between an open position and a closed position.

2. The strapping device of claim 1, wherein one of the second covering legs of the pair of second strap channel flaps partially defines a wedge-shaped strap pull-out contour.

3. The strapping device of claim 1, wherein each of the first covering legs of the pair of first strap channel flaps partially defines a first wedge-shaped strap pull-out contour, and wherein each of the second covering legs of the pair of second strap channel flaps partially defines a second wedge-shaped strap pull-out contour.

4. The strapping device of claim 1, wherein one of the second covering legs of the pair of second strap channel flaps partially defines a wedge-shaped strap pull-out contour, and said second covering leg comprises a tip and widens from the tip to partially define the wedge-shaped strap pull-out contour.

5. The strapping device of claim 1, wherein the upwardly extending covering extension of one of the second covering legs of the pair of second strap channel flaps extends at an increasing distance away from the strap channel.

6. The strapping device of claim 1, wherein each second covering leg of the pair of second strap channel flaps overlies approximately half of a respective one of the first covering legs of the pair of first strap channel flaps.

7. The strapping device of claim 1, wherein each second covering leg of the pair of second strap channel flaps overlies a parting joint between the first strap channel flap and the second strap channel flap, respectively.

8. The strapping device of claim 1, wherein one of the second covering legs of the pair of second strap channel flaps partially defines a wedge-shaped strap pull-out contour, wherein said second covering leg comprises a tip and widens from the tip to partially define the wedge-shaped strap pull-out contour, and wherein the upwardly extending covering extension of said second covering leg extends at an increasing distance away from the strap channel.

9. A strapping device comprising:

a packing table;

a strapping frame at least partially above the packing table and at least partially defining a strap channel having a strap channel opening;

a pair of first strap channel flaps connected to the strapping frame, each first strap channel flap comprising a first covering leg that overlies part of the strap channel opening; and a pair of second strap channel flaps connected to the strapping frame adjacent to the pair of first strap channel flaps, each second strap channel flap comprising a second covering leg that overlies part of the strap channel opening, wherein each second covering leg overlies approximately half of a respective one of the first covering legs of the pair of first strap channel flaps, wherein each first strap channel flap is movable independently of each second strap channel flap between an open position and a closed position.

10. The strapping device of claim 9, wherein one of the second covering legs of the pair of second strap channel flaps partially defines a wedge-shaped strap pull-out contour.

11. The strapping device of claim 9, wherein each of the first covering legs of the pair of first strap channel flaps partially defines a first wedge-shaped strap pull-out contour, and wherein each of the second covering legs of the pair of second strap channel flaps partially defines a second wedge-shaped strap pull-out contour.

12. The strapping device of claim 9, wherein one of the second covering legs of the pair of second strap channel flaps partially defines a wedge-shaped strap pull-out contour, and said second covering leg comprises a tip and widens from the tip to partially define the wedge-shaped strap pull-out contour.

13. The strapping device of claim 9, wherein one of the second covering legs of the pair of second strap channel flaps comprises an upwardly extending covering extension.

14. The strapping device of claim 9, wherein one of the second covering legs of the pair of second strap channel flaps comprises an upwardly extending covering extension that extends at an increasing distance away from the strap channel.

15. The strapping device of claim 9, wherein each of the first covering legs of the pair of first strap channel flaps comprises an upwardly extending covering extension, and wherein each of the second covering legs of the pair of second strap channel flaps comprises an upwardly extending covering extension.

16. The strapping device of claim 9, wherein each second covering leg of the pair of second strap channel flaps overlies a parting joint between the first strap channel flap and the second strap channel flap, respectively.

17. The strapping device of claim 9, wherein one of the second covering legs of the pair of second strap channel flaps partially defines a wedge-shaped strap pull-out contour, wherein said second covering leg comprises a tip and widens from the tip to partially define the wedge-shaped strap pull-out contour, and wherein said second covering leg comprises an upwardly extending covering extension that extends at an increasing distance away from the strap channel.

* * * * *